US008192011B2

(12) United States Patent
Abramovitch

(10) Patent No.: US 8,192,011 B2
(45) Date of Patent: Jun. 5, 2012

(54) SYSTEM AND METHOD FOR DISCHARGING STATIC IN A PRINTER

(75) Inventor: Tal Abramovitch, Modiin (IL)

(73) Assignee: Matan Digital Printers Ltd., Rosh Ha'Ayin (IL)

( * ) Notice: Subject to any disclaimer, the term of this patent is extended or adjusted under 35 U.S.C. 154(b) by 566 days.

(21) Appl. No.: 12/383,148

(22) Filed: Mar. 20, 2009

(65) Prior Publication Data

US 2010/0165063 A1 Jul. 1, 2010

(30) Foreign Application Priority Data

Dec. 25, 2008 (IL) ..... 196203

(51) Int. Cl.
*B41J 2/01* (2006.01)
*B41J 29/38* (2006.01)

(52) U.S. Cl. ..... 347/101; 347/16

(58) Field of Classification Search ..... None
See application file for complete search history.

(56) References Cited

U.S. PATENT DOCUMENTS 3,829,080 A * 8/1974 Braen et al. ..... 493/11
4,628,331 A * 12/1986 Ishikawa ..... 347/34
4,898,487 A * 2/1990 Brull et al. ..... 400/354
5,396,078 A * 3/1995 Klaus et al. ..... 250/551
5,755,399 A * 5/1998 Halvonik et al. ..... 242/615
5,961,023 A * 10/1999 Mattila ..... 226/187
6,243,120 B1 * 6/2001 Hevenor et al. ..... 347/217
7,036,898 B2 * 5/2006 Edelen et al. ..... 347/9
7,044,595 B2 * 5/2006 Youn ..... 347/104
7,300,136 B2 11/2007 Patterson et al.
2005/0185016 A1 * 8/2005 Mori et al. ..... 347/33

FOREIGN PATENT DOCUMENTS

JP 60104368 A * 6/1985
JP 07237293 9/1995
JP 2008044742 2/2008
KR 4002100 1/2004

* cited by examiner

*Primary Examiner* — Stephen Meier
*Assistant Examiner* — Leonard S Liang
(74) *Attorney, Agent, or Firm* — Robert G. Lev; Michael Factor

(57) ABSTRACT

A method of preventing electrostatic charge build up on a print media from adversely affecting quality of inkjet printing, comprising: (a) coupling a static discharging wand to print head carriage at a set distance ahead of inkjet print heads and altitude over print media, and (b) coupling the static discharge wand to a power unit to provide a potential difference between said static discharge wand and said print media.

20 Claims, 2 Drawing Sheets

SYSTEM AND METHOD FOR DISCHARGING STATIC IN A PRINTER

PRIORITY INFORMATION

The present invention claims priority to Israeli Patent Application No. 196203 filed on Dec. 25, 2008, making reference thereto and incorporating same herein, in its entirety.

FIELD OF THE INVENTION

The present invention is directed to a system and associated method for discharging static from media to be printed upon, particularly but not exclusively in wide format printers.

BACKGROUND OF THE INVENTION

The friction of two materials rubbing against each other causes the "triboelectric" phenomenon known as static charge. Static buildup is common in conveying systems and printers. If the static electricity does not have a grounded path to follow it can lead to an Electro Static Discharge (ESD) which can, in turn, cause short circuiting of electronic components, induce a fire or cause difficulties in moving material paper, plastic sheeting etc. through a piece of equipment.

Many media to be printed onto, particularly polymeric sheets and the like, are insulating in nature and have a tendency to accumulate static charge. Often, to prevent such media becoming soiled, the sheets or rolls are wrapped in polyethylene or other material which is, itself insulating. Removal of such films tends to cause electrons to be transferred between wrapping and media and in consequence thereof, both become electrostatically charged. The printing process itself requires the media to be fed past the print head. Typically rollers are used and the media is stretched over and fed past a print table. Relative movement of insulating materials, particularly where there is friction, tends to cause additional static build up.

There are a large number of charge-based injection processes wherein droplets of ink are intentionally charged as a means of directive spraying. The very process of atomization, i.e. of breaking a liquid into droplets that is essential to inkjet printing shears the ink and causes charging of the droplets. It will be appreciated that inkjet printing requires injection of drops of ink through accurately machined nozzles onto the media and this causes charging of the droplets. For printing onto polymeric materials, whether plastic sheets, netting used for covering buildings with advertising, or plastic coated papers, the ink is generally oil based and highly susceptible to charge build up. Where the media is charged, the droplets get attracted or repelled by areas of charge concentration, such as defects on the micro-surface. This lowers the precision of the printing process and thus the resolution and accuracy of the end result. It is not just oil based inks of course, since each water molecule has a dipole moment, droplets of water based ink get attracted or rejected by static charges and non-controlled static build up adversely affects the resolution and quality of the printing.

It will be appreciated that the wider the print media, the more charge and the more unevenly charge can build up there-across. Thus the problems of static are exasperated by wide format printers and even more so by extra wide format printers, where the media can be from 60 cm to 3 m, 5 m or even 10 m wide.

Wide format inkjet printing is commonly used for printing posters, wall decorations, signs and the like. The medium to be printed, if flexible, is typically provided on a continuous roll and is advanced, roll to roll, past the print head. Sometimes however, particularly when printing onto a stiff material, the material to be printed is provided in sheet form and the printing technique is then known as flat-bed printing. Dual mode printers are designed for high resolution printing onto both flexible and rigid substrates. An example of such a printer, is Applicant's co-pending patent application, U.S. Ser. No. 11/693,449, incorporated herein by reference, in its entirety, which discloses a wide or super wide digital printer comprising a print head box that reciprocates from left to right across a wide or super wide printing table having a length of less than 20 cm that is supported by a fixed support, and a feed roller and a guiding roller that are moveably coupled to the fixed support, wherein the wide or super wide digital printer is alternatively configurable as (a) a roll to roll printer by lowering the feed roller and the guiding roller to a lowered configuration wherein uppermost parts of the feed roller and the guiding roller are below the upper surface of printing table, or (b) as a discontinuous sheet printer by raising the feed roller and the guiding roller to a raised configuration wherein the uppermost parts of the feed roller and the guiding roller are collinear with the upper surface of the printing table. Here again, the relative movement of the parts with respect to each other may cause charge build up.

As elegantly demonstrated in Milliken's famous oil-drop experiment, droplets can be suspended in charge fields and thus the adverse affect static charge can have on the accurate placing of inks onto print media cannot be overstated.

The current state of the art is typically to wipe a damp cloth over print media rolls once mounted onto the printer feeder and periodically to wipe such a cloth over the print head, thereby discharging static. Anti-static brushes are sometimes used as well. However, such techniques are severely limited in their effectiveness.

Korean Patent Application Number KR4002100 titled "Apparatus for Removing Static Electricity of Ink Jet Printer" describes a static electricity control apparatus for ink-jet printer having a pinch roller with shaft being rotatably supported on holder, and a ground unit for grounding the pinch roller to a metallic frame. Essentially a static electricity removing apparatus for an ink jet printer is provided to remove static electricity which is generated when a paper is conveyed by connecting a grounding member to a pinch roller. The printer includes a frame and has a paper feeding section provided at a lower portion of the frame. A feeding roller conveys paper from the paper feeding section towards a print head. A pinch roller makes contact with the feeding roller to convey the paper. The pinch roller is rotatably supported by means of a holder. A grounding member is provided to remove static electricity from the papers passing through the feeding roller and the pinch roller. One end of the grounding member is connected to a shaft and the other end of the grounding member is connected to the frame. Such a grounding system is not really suitable for wide format printers that often print onto polymer mediums.

U.S. Pat. No. 7,300,136 titled "Ink Tubing Chain Slider for Wide Format Printer" describes an ink jet printer that includes a carriage mounted on a guide. The carriage provides a transverse movement to a print-head. The carriage includes an upper carriage component adjacent to a rear support wall of the ink jet printer and a lower carriage component mounted to the upper carriage component. A slider is disposed between the upper carriage and the rear support wall. The slider includes a rigid substrate with a hole or an eyelet forming a hole. A pin secured to the carriage engages the hole and allows the slider to rotate up to 360 degrees around the pin. The slider includes a fabric with extended fibers secured to the substrate or directly to the carriage in order to resist static charge accumulations and to lower friction.

This system is designed for a wide format printer and addresses some of the requirements thereof, in particular, the accumulation of static charge due to movement of the print head carriage. It does nothing to discharge the large static charges that might accumulate from the unwrapping of the medium and from the triboelectric build up caused by the advancing system used for moving the medium past the print stage.

Japanese patent application number JP07237293A2 titled "Ink Jet Printer" describes an ink jet printer in which static electricity charged on paper is removed to protect the print head from damage.

A discharge means for discharging static electricity charged on paper is disposed on upstream and downstream sides of an ink jet head in the paper feed direction. The upstream discharge means is composed of a grounded paper feed roller and a pinch roller. The downstream discharge means is composed of a grounded transport roller for transporting paper in contact with a non-printing surface of the paper and a discharge brush. Bristle tips of the discharge brush are directed to the head out of contact with the paper. The system described is useful for discharging static of the amounts that accumulate on A4 or American foolscap paper. Unfortunately, it does not scale up to the requirements for wide format printing onto polymeric media.

Japanese patent application number JP2008044742A2 titled "Ink Jet Printer and Method of Eliminating Static Electricity from Print Medium for Ink Jet Printer" attempts to remove charges on the surface of a print medium even when the frequency of polarity change or the potential of an applied voltage for charging a conveyor belt is varied. When a voltage applied to a print medium charging roller is zero, the potential on the surface of the print medium in contact with the print medium charging roller on the opposite side of the conveyor belt is detected from the partial voltage of the voltage generated in the print medium charging roller. A print medium AC charging pattern signal (applied voltage) to the print medium charging roller is so controlled that the detected potential on the surface of the print medium on the opposite side of the conveyor belt can be suppressed. Consequently, the charges on the surface of the print medium can be effectively removed even when the frequency of the polarity change or the potential of the conveyor belt AC charging pattern signal (applied voltage) for charging the conveyor belt is varied.

The system described apparently applies a carefully controlled discharging voltage to a discharging roller. The limitations thereof, particularly for wide format printing onto polymer sheets will be apparent to persons of the art.

There is a need for more effective systems and methods of discharging static charge from print media, particularly from wide, polymeric media, and the present invention addresses this need.

SUMMARY OF THE INVENTION

Electrostatic discharge (ESD) is the sudden and momentary electric current that flows between two objects at different electrical potentials. The term is usually used in the electronics and other industries to describe momentary unwanted currents that may cause damage to electronic equipment. Controlled electrostatic discharge can be used to remove static charges.

In a first aspect, the present invention is directed to a method of preventing electrostatic charge build up on a print media from adversely affecting quality of inkjet printing, comprising the steps of:

(a) coupling a static discharging wand to print head carriage at a set distance ahead of inkjet print heads and altitude over print media, and (b) coupling the static discharge wand to a power unit to provide a potential difference between said static discharge want and said print media.

Of note, in preferred embodiments, the inkjet printer includes an advancing means for advancing the medium past the print table and the wand is coupled to lie in direction of advancement, perpendicular to the print table.

Of note, in preferred embodiments, the wand moves with respect to the printer table.

Of note, in preferred embodiments, two wands are supplied, coupled on either side of the print-head, to remove static before the print head as it moves back and forth along its track, to enable printing onto a substantially static free section of the medium.

Typically, the static discharge wand is positioned between 5 cm and 60 cm in front of the print head.

Preferably, static discharge wand is positioned between 20 cm and 40 cm in front of the print head.

Most preferably, the discharge wand is positioned about 30 cm in front of the print head.

Typically, static discharge wand has an altitude of less than 8 cm above the print medium.

More preferably, the static discharge wand has an altitude of more than 1 cm above the print medium.

Most preferably, the static discharge wand is about 19 mm above the surface of the print medium.

Typically, the static discharge wand is between 5 cm and 40 cm long; and more typically between 10 cm and 20 cm long. In one embodiment, the effective length of the discharge rod is 30 cm long.

Typically, the power unit causes a potential difference of between 1 kV and 1 MV between static discharge wand and print medium.

More typically, the power unit causes a potential difference of between 5 kV and 10 kV between static discharge wand and print medium.

Typically, the static discharge wand has discharge points every 10 mm to 30 mm therealong. More typically, the discharge points are every 20 mm.

In a second aspect, the present invention is directed to providing an inkjet printer, comprising at least one inkjet print head mounted on a print head carriage for reciprocally traveling along a track over a print table and further comprising:

(i) a static discharging wand mounted to the print head carriage ahead of the print head carriage in direction of movement thereof at an appropriate altitude over print media, and the static discharging wand being electrically coupled to (ii) a power unit for maintaining a potential difference between said static discharge wand and said print media.

Of note, in preferred embodiments, the inkjet printer includes an advancing means for advancing the medium past the print table and the wand is coupled to lie in direction of advancement, perpendicular to the print table.

Of note, in preferred embodiments, the wand moves with respect to the printer table.

Of note, in preferred embodiments, two wands are supplied, coupled on either side of the print-head, to remove static before the print head as it moves back and forth along its track, to enable printing onto a substantially static free section of the medium.

The printer is typically a wide format printer, having a printing width of at least 0.5 m, and optionally 3 m, 5 m or 10 m.

Typically, the printer is selected from the group comprising flat bed printers, roll to roll printers and dual mode printers.

BRIEF DESCRIPTION OF FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice.

In the accompanying drawings:

FIG. 1 is a schematic illustration of the print-head carriage and other main elements of a wide format, roll-to-roll printer of the prior art;

FIG. 2 is a schematic illustration of the print-head carriage and other main elements of a wide format, roll-to-roll printer with system for discharging static in accordance with an embodiment of the present invention, and FIG. 3 is a flowchart illustrating a method of discharging electrostatic in accordance with an embodiment of the present invention.

DESCRIPTION OF EMBODIMENTS

Figure 1:
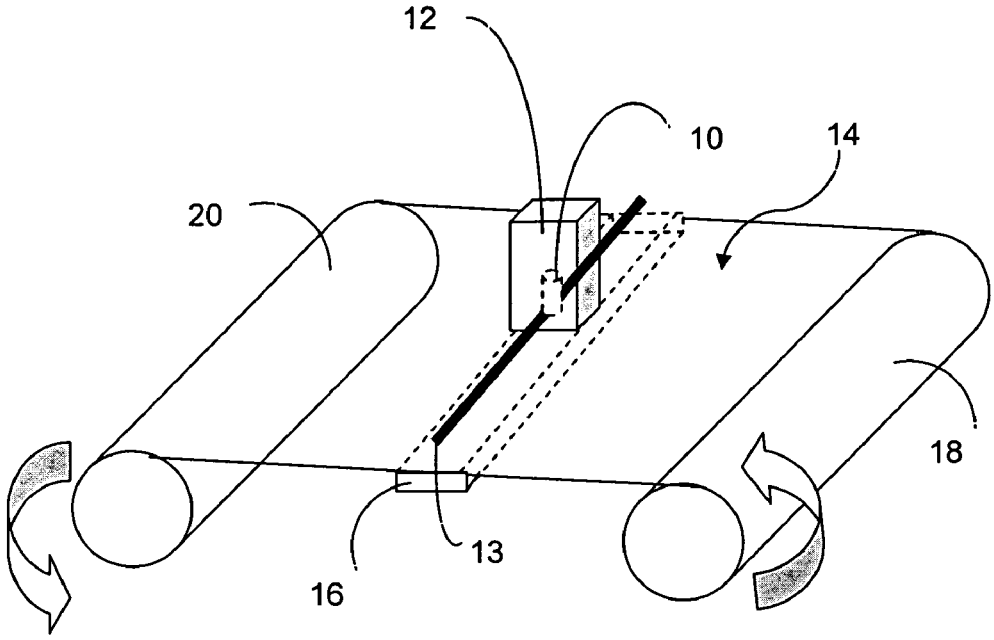
PRIOR ART Fig. 1

With reference to FIG. 1, a schematic, simplified representation of a prior art print head 10 on a print head carriage 12, for traveling along a track 13 over and across a print medium 14 is shown. The print medium 14 is placed over a print table 16, and the carriage 12 moves along the track 13, over the print table 16 and across the print medium 14. Ink is selectively injected through nozzles on inkjet print head 10 onto medium 14. Depending on nature of ink and medium 14, sometimes the ink dries by solvent evaporation, and sometimes it requires curing by exposure to ultraviolet light. After passage of carriage 12 along the track 13, the medium 14 is advanced thereover. Where medium 14 is provided as roll-stock, the conveying is typically by a roll-to-roll conveying means from feed roll 18 to take up roll 20. In flatbed printers, or in the flatbed mode of dual mode printers, the feed mechanism is different, but in most cases, particularly when printing onto polymer films and other insulators, static charging is a problem.

Figure 2:
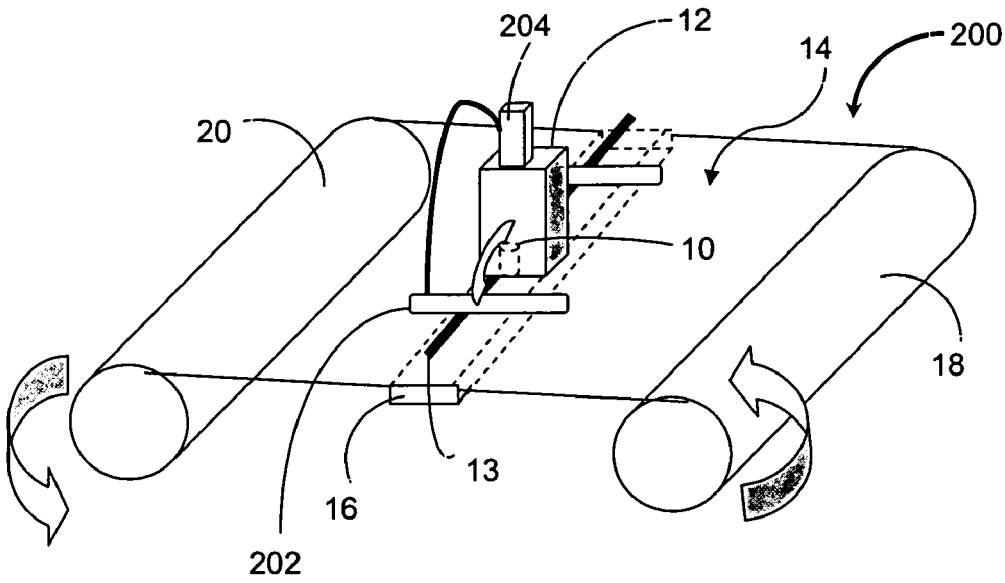

With reference to FIG. 2, a print system 200 for a print medium 14 of an embodiment of the invention consists of a print-head 10 on a print head carriage 12, a print table 16, a feed roll 18 and a take up roll 20, mutatis mutandis. An electrostatic discharge wand 202 is provided upstream of the print carriage 12 and in close proximity to the print medium 14. Electrostatic discharge wand 202 is mounted onto the print head carriage 12 and moves therewith. The electrostatic discharge wand 202 is connected to a power unit 204 which maintains a large potential difference between the electrostatic discharge wand 202 and the print medium 14. This causes regular electrostatic discharges (ESD), i.e. momentary electric current that dissipates the static charges from the print medium 14. The electrostatic discharge wand 202 has periodic pointed protrusions every few millimeters, say every centimeter or so therealong. These act to concentrate the potential field to facilitate the electrostatic discharge. Such discharge rods are commercially available components. One such wand, found to perform adequately, is the model 21 Shockless Static Bar P/N #91701-0XXXX supplied by Electrostatics Incorporated, Harlsysville Pa. 19438-2017. This component is commercially available, epoxy filled, easily installed, compact and has a high ionization output and is shockless. The bar is designed for long distance neutralization and includes a current limiting resistor network for personnel protection, so even touching an ionization point does not give a sensation of shock.

The Shockless Static Bar comes in various lengths from 3" to 10' and an appropriate length for the discharge wand 202 that is compatible with the dimensions and requirements of one embodiment of a wide format printer is 33" overall length, having an effective length of 30". It is ⅝" wide and ¾" high.

The wand may be mounted a few inches, say 3" to 24", but preferably about 12" (30 cm) in front of the print head 10. Where the model 21 Shockless Static Bar is used, it has been found effective if placed within 8" (20 cm) above the print medium 14, and empirically, for typical polymeric media as in common use, the most effective height has been determined to be 19 mm over the print medium. Since the Shockless Static Bar is coupled to the print head carriage 12, as with the print heads themselves, the distance between the surface of the medium 14 and the electrostatic discharge wand 202 is an engineering parameter that can be optimized for different systems.

Consequently, the bar performs effectively for a wide range of material and the power unit 204, which typically provides a potential of perhaps 7 kV or so, is usefully mounted on the print head carriage 12. Since print head carriage 12 is typically designed to reciprocate along the print table 16, printing in both directions, preferably an electrostatic discharge wand 202 is mounted at each side of the carriage 12. This arrangement keeps the print medium 14 opposite the print-heads 10 substantially uncharged and ensures high quality, accurate printing, enabling a high resolution quality result. The Shockless Static Bar has discharge points every centimeter or so along the wand, specifically every 19.2 mm. This is presumably largely the reason, why the empirically determined optimum altitude over the print medium is also 19 mm.

The model 21 Shockless Static Bar comes with an appropriate power unit 204: the Electrostatics Model T1246SL (120 Volt 50/60 Hz) for use in the US, and the T2246SL model (220 V 50/60 Hz) for use in Europe, Israel and elsewhere.

It will be noted that although discharge rods are known, commercially available components used for discharging static electricity, they have not hitherto been coupled to the print-head carriage 12 of an inkjet printer 100 to travel with the inkjet heads 10 and to discharge static from the medium 14, in the area thereof, before the inkjet heads 10.

Of note, in preferred embodiments, the inkjet printer 100 includes an advancing means for advancing the medium past the print table and the discharge wand 102 is coupled to lie in direction of advancement, perpendicular to the print table 16.

Of note, in preferred embodiments, the discharge wand 202 moves with respect to the printer table 16 and scans over the medium 14, in contradistinction to both brushes of the prior art and usual usage of such discharge wands 202, which are typically static with respect to conveyors and other advancing means, which result in accumulation of static.

Of note, in preferred embodiments, two wands 202 are supplied, coupled on either side of the print-head carriage 12, to remove static before the print head 10 as it moves back and forth along its track 13, to enable printing onto a substantially static free section of the medium 14.

The printer is typically a wide format printer, having a printing width of at least 0.5 m, and optionally 3 m, 5 m or 10 m.

Typically, the printer is selected from the group comprising flat bed printers, roll to roll printers and dual mode printers.

Figure 3:
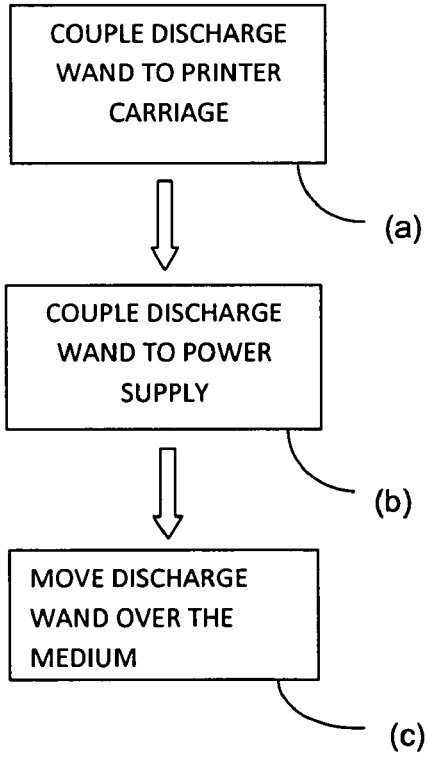

With reference to FIG. 3, an aspect of the present invention is directed to a corresponding method of preventing electrostatic charge build up on a print media from adversely affecting quality of inkjet printing, comprising the steps of: (a) coupling a static discharging wand to print head carriage at a set distance ahead of inkjet print heads and altitude over print media, (b) coupling the static discharge wand to a power unit to provide a potential difference between said static discharge wand and the print media, and (c) moving discharge wand over the medium.

It will be appreciated that the various dimensions and potentials given above are by way of non-limiting example only, and that they are interrelated in that as amplitude increases, the appropriate potential has to increase as well.

In flatbed printers, or in flatbed mode of dual printers, the feed mechanism is different, but in most cases, particularly when printing onto polymer films and other insulators, static charging is a problem. Although discussed above with respect to wide format roll-to-roll inkjet printing where the problems of static buildup are particularly acute, embodiments of the invention are applicable for use with flat bed printers and printers for use with narrower formats. Thus persons skilled in the art will appreciate that the present invention is not limited to what has been particularly shown and described hereinabove. Rather the scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

I claim:

1. A method of preventing electrostatic charge build up on a print media from adversely affecting quality of inkjet printing, comprising:

(a) coupling a first static discharging wand to a print head carriage at a set distance ahead of inkjet print heads and altitude over print media, and (b) coupling the static discharge wand to a power unit to provide a potential difference between said static discharge wand and said print media.

2. The method of claim 1, wherein the inkjet printer includes an advancing means for advancing the medium past the print table and the static discharge wand is coupled to lie in direction of advancement, essentially parallel to the medium, but perpendicular to the print table.

3. The method of claim 1, wherein the wand moves with respect to the printer table.

4. The method of claim 1, wherein a second static discharge wand is coupled on at a set distance on opposite side of the print-head from the first discharge wand, to remove static ahead of the print head as it moves in opposite direction along its track.

5. The method of claim 1, wherein the inkjet printer is a wide format ink-jet printer for printing on a medium having a width of at least 50 cm.

6. The method of claim 1, wherein said static discharge wand is coupled between 5 cm and 50 cm in front of the print head.

7. The method of claim 1, wherein said static discharge wand has an altitude of between 1 cm and 20 cm above the print medium.

8. The method of claim 1, wherein said static discharge wand is between 5 cm and 60 cm long.

9. The method of claim 1, wherein said power unit causes a potential difference of between 1 kV and 1 MV between static discharge wand and print medium.

10. The method of claim 1, wherein said power unit causes a potential difference of between 5 kV-10 kV between static discharge wand and print medium.

11. An inkjet printer, comprising at least one inkjet print head mounted on a print head carriage for reciprocally traveling along a track over a print table and further comprising:

(i) a static discharging wand mounted to the print head carriage ahead of the print head carriage in direction of movement thereof at an appropriate altitude over print media, and the static discharging wand being electrically coupled to (ii) a power unit for maintaining a potential difference between said static discharge wand and said print media.

12. The inkjet printer of claim 11, further comprising an advancing means for advancing the medium past the print table, wherein the static discharge wand is coupled to lie in direction of advancement of medium, essentially parallel to the medium and perpendicular to the print table.

13. The inkjet printer of claim 12 wherein said static discharge wand is coupled between 20 cm and 40 cm in front of the print head.

14. The inkjet printer of claim 12 wherein said static discharge wand has an altitude fulfilling at least one of the conditions of being:

(a) less than 20 cm above the print medium, and (b) more than 1 cm above the print medium.

15. The inkjet printer of claim 12 wherein said static discharge wand is between 10 cm and 60 cm long.

16. The inkjet printer of claim 12 wherein said power unit is configured to apply a potential difference of between 1 kV and 1 MV between static discharge wand and print medium.

17. The inkjet printer of claim 11, wherein the wand moves with respect to the printer table.

18. The inkjet printer of claim 11, wherein a second static discharge wand is coupled on at a set distance on opposite side of the print-head from the first discharge wand, to remove static ahead of the print head as it moves in opposite direction along its track.

19. The inkjet printer of claim 11 for printing onto a medium having a width of 0.5 m.

20. The inkjet printer of claim 11 wherein said static discharge wand is coupled between 5 cm and 60 cm in front of the print head.

* * * * *